US009079392B2

(12) United States Patent
Nystrom

(10) Patent No.: US 9,079,392 B2
(45) Date of Patent: Jul. 14, 2015

(54) DOUBLE SIDED FLEX FOR IMPROVED BUMP INTERCONNECT

(71) Applicant: XEROX CORPORATION, Norwalk, CT (US)

(72) Inventor: Peter J. Nystrom, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 37 days.

(21) Appl. No.: 14/038,108

(22) Filed: Sep. 26, 2013

(65) Prior Publication Data

US 2015/0085019 A1 Mar. 26, 2015

(51) Int. Cl.
*B41J 2/16* (2006.01)
*B41J 2/045* (2006.01)

(52) U.S. Cl.
CPC ..... *B41J 2/04581* (2013.01); *B41J 2/1607* (2013.01); *B41J 2/1637* (2013.01)

(58) Field of Classification Search
CPC ..... B41J 2002/14491; B41J 2/14072; B41J 2/1623; B41J 2202/20; B41J 2/14024
USPC ..... 347/50, 51; 174/254; 361/749, 767
See application file for complete search history.

(56) References Cited

U.S. PATENT DOCUMENTS

| | | | | |
|---|---|---|---|---|
| 2002/0076919 | A1* | 6/2002 | Peters et al. | 438/637 |
| 2006/0192579 | A1* | 8/2006 | Jacobsen et al. | 324/758 |
| 2008/0316255 | A1* | 12/2008 | Kubo et al. | 347/40 |
| 2010/0284158 | A1* | 11/2010 | Sutardja | 361/749 |
| 2011/0298871 | A1 | 12/2011 | Stephens et al. | |
| 2012/0274708 | A1 | 11/2012 | Nystrom et al. | |
| 2013/0061469 | A1* | 3/2013 | Dolan et al. | 29/830 |

OTHER PUBLICATIONS

Bryan R. Dolan et al., "Method for Flex Circuit Bonding Without Solder Mask for High Density Electrical Interconnect", U.S. Appl. No. 13/472,734, filed May 16, 2012.
Peter J. Nystrom et al., "Structure and Method to Fabricate Tooling for Bumping Thin Flex Circuits", U.S. Appl. No. 13/721,896, filed Dec. 20, 2012.

* cited by examiner

*Primary Examiner* — Manish S Shah
*Assistant Examiner* — Yaovi Ameh
(74) *Attorney, Agent, or Firm* — MH2 Technology Law Group LLP

(57) ABSTRACT

A printhead including a plurality of embossed first flex circuit pads and a first plurality of first active traces on a first side of a dielectric substrate, and a plurality of embossed second flex circuit pads on a second side of the dielectric substrate. The plurality of embossed first flex circuit pads are configured to be electrically active as part of an electric circuit during operation of the printhead, while the plurality of embossed second flex circuit pads may be configured to be electrically active or electrically inactive during operation of the printhead.

20 Claims, 5 Drawing Sheets

DOUBLE SIDED FLEX FOR IMPROVED BUMP INTERCONNECT

TECHNICAL FIELD

The present teachings relate to the field of ink jet printing devices and, more particularly, to methods and structures for high density piezoelectric ink jet print heads and a printer including a high density piezoelectric ink jet print head.

BACKGROUND

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored, for example because they can use a wider variety of inks.

Piezoelectric ink jet print heads include an array of piezoelectric elements (i.e., transducers or PZTs). One process to form the array can include detachably bonding a blanket piezoelectric layer to a transfer carrier with an adhesive, and dicing the blanket piezoelectric layer to form a plurality of individual piezoelectric elements. A plurality of dicing saw passes can be used to remove all the piezoelectric material between adjacent piezoelectric elements to provide the correct spacing between each piezoelectric element.

Piezoelectric ink jet print heads can typically further include a flexible diaphragm to which the array of piezoelectric elements is attached. When a voltage is applied to a piezoelectric element, typically through electrical connection with an electrode electrically coupled to a power source, the piezoelectric element bends or deflects, causing the diaphragm to flex which expels a quantity of ink from a chamber through a nozzle. The flexing further draws ink into the chamber from a main ink reservoir through an opening to replace the expelled ink.

Increasing the printing resolution of an ink jet printer employing piezoelectric ink jet technology is a goal of design engineers. One way to increase the jet density is to increase the density of the piezoelectric elements.

To attach an array of piezoelectric elements to pads or electrodes of a flexible printed circuit (flex circuit) or to a printed circuit board (PCB), a quantity (e.g., a microdrop) of conductor such as conductive epoxy, conductive paste, or another conductive material is dispensed individually on the top of each piezoelectric element. Electrodes of the flex circuit or PCB are placed in contact with each microdrop to facilitate electrical communication between each piezoelectric element and the electrodes of the flex circuit or PCB.

Achieving reliable electrical connections or interconnects between piezoelectric elements and a circuit layer becomes more challenging at increasing print head resolutions. Design constraints that require dimensionally smaller PZTs reduce both the surface area available for forming an electrical interconnect such as electrical trace routings (traces) as well as the area for its surrounding bond adhesive. For example, openings within a standoff layer for an electrical connection between the circuit layer and PZT can be decreased by more than 60% across an array having 600 dots per inch (dpi) compared to an array having 300 dpi. Similarly, an effective bonding area can be reduced by more than 40% across an array having 600 dpi compared to an array having 300 dpi. This reduction in bond area can result in weaker electrical interconnects that may fail after stressing due, for example, to thermal cycling, thermal aging, and PZT actuations.

An ink jet printhead having increased PZT and trace density and improved flex circuit pads formation and strength would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A printhead in accordance with the present teachings may include a dielectric substrate comprising a first side and a second side opposite the first side, a first plurality of first active traces on the first side of the dielectric substrate, a plurality of embossed first flex circuit pads on the first side of the dielectric substrate, and a plurality of embossed second flex circuit pads on the second side of the dielectric substrate. At least a portion of one of the plurality of embossed second flex circuit pads directly overlies each of the plurality of embossed first flex circuit pads. The plurality of embossed first flex circuit pads may be configured to be electrically active during operation of the printhead, and the plurality of embossed second flex circuit pads may be configured to be electrically active or electrically inactive during operation of the printhead.

A printer in accordance with an embodiment of the present teaching may include a printhead, the printhead including a dielectric substrate having a first side and a second side opposite the first side, a first plurality of first active traces on the first side of the dielectric substrate, a plurality of embossed first flex circuit pads on the first side of the dielectric substrate, and a plurality of embossed second flex circuit pads on the second side of the dielectric substrate. At least a portion of one of the plurality of embossed second flex circuit pads directly overlies each of the plurality of embossed first flex circuit pads. The plurality of embossed first flex circuit pads may be configured to be electrically active during operation of the printhead, and the plurality of embossed second flex circuit pads may be configured to be electrically active or electrically inactive during operation of the printhead. The printer may further include a printer housing that encases the printhead.

A method for forming a printhead in accordance with an embodiment of the present teachings may include forming a first plurality of first active traces on a first side of a dielectric substrate, forming a plurality of first flex circuit pads on the first side of the dielectric substrate, forming a plurality of second flex circuit pads on the second side of the dielectric substrate, wherein at least a portion of one of the plurality of second flex circuit pads directly overlies each of the plurality of first flex circuit pads, embossing the plurality of first flex circuit pads to form a plurality of embossed flex circuit pads, and embossing the plurality of second flex circuit pads to form a plurality of embossed second flex circuit pads. The plurality of embossed first flex circuit pads may be configured to be electrically active during operation of the printhead, and the plurality of embossed second flex circuit pads may be configured to be electrically active or electrically inactive during operation of the printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
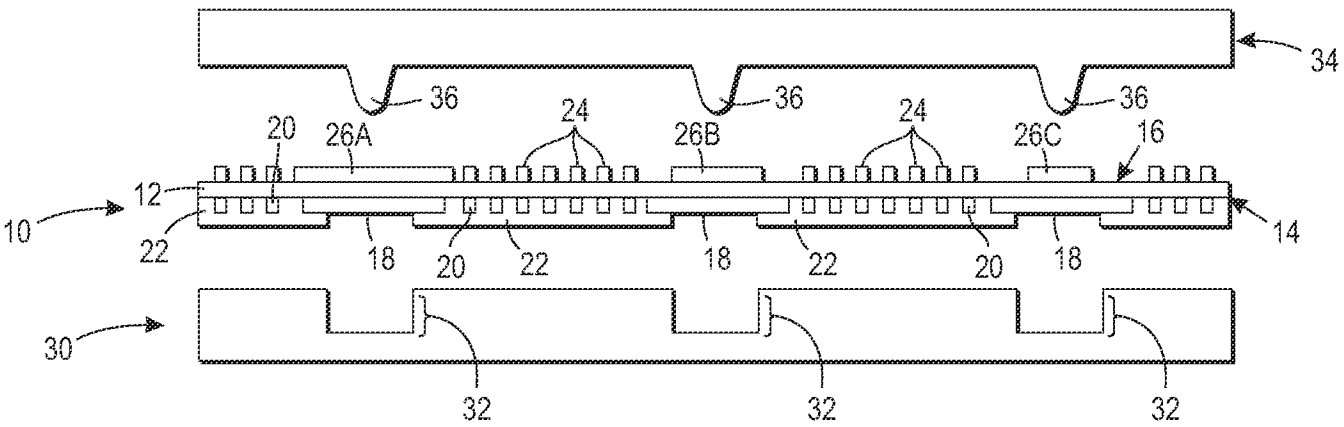
FIG. 1 is a cross section depicting an unembossed flexible printed circuit (flex circuit) between an embossing die and an embossing post plate in an embodiment of the present teachings.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

Achieving reliable electrical connections (electrical interconnects) between piezoelectric elements (i.e., piezoelectric transducers, PZTs) and a circuit layer such as a printed circuit board (PCB) or flexible printed circuit (flex circuit) becomes more challenging at increasing print head resolutions. Design constraints that require dimensionally smaller PZTs reduce both the surface area available for forming an electrical interconnect as well as the area for its surrounding bond adhesive. The opening within a standoff layer for connection of a circuit layer to a PZT is reduced as PZT density in a PZT array is increased. Similarly, the effective bond area between the PZT and the circuit layer is also reduced with increasing print resolutions. This reduction in bond area can result in weaker electrical interconnects that may fail after stressing due, for example, to thermal cycling, thermal aging, and PZT actuations.

An embodiment of the present teachings can result in a more robust physical connection between the circuit layer and the PZT array, and may result in decreased stresses on the interconnection which electrically couples the PZT to the circuit layer.

The formation of embossed flexible (flex) circuit pads have been disclosed. For example, US Publications 20110298871 and 20120274708, and co-pending U.S. application Ser. No. 13/721,896, each of which is commonly assigned herewith to Xerox Corporation and incorporated herein by reference in its entirety, disclose various methods and structures for embossed flex circuit pads. Embossed flex circuit pads, which include a metal pad on a polymer substrate, are formed to have a contour that places the circuit pad closer to the PZT than a planar flex circuit pad. The contour of the embossed flex circuit pads is targeted for a height that is compatible with the printhead design. Embossed flex circuit pads may be electrically coupled to a PZT using a conductor such as a flowable metal conductor or conductive paste, or electrical contact may be established between a PZT and a flex circuit pad through asperity contact without the use of a separate conductor. In the case of asperity contact, a sufficient contour height is used to maintain a sufficient force between the flex circuit pad and the PZT such that continuous reliable electrical contact is maintained between the pad and the PZT.

During the formation of an embossed flex circuit, for example a flex circuit having a plurality of copper pads on one side of the flex circuit, the unembossed flex circuit may be placed pad side down onto an embossing die having a plurality of openings therein, wherein an individual pad overlies each of the openings. An embossing post plate having a plurality of protruding posts is aligned with the die, and each post is placed into physical contact with the flex circuit over one of the flex circuit pads. Each post is then extended through one of the openings in the die, which also deflects the pad and its supporting polymer substrate into the opening, thereby embossing the pad with a contour. The flex circuit is then removed from between the die and post plate to result in an embossed flex circuit. During the embossing, the post may exert a stretching effect on the copper pad as the pad extends into the opening in the die. It has been found that, after embossing, the pad may relax or contract, thereby decreasing the height of the embossed pad. While not intending to be bound by any specific theory, the relaxing may be caused in part by the polymer substrate physically resisting reshaping during the embossing process, which forces the metal pad toward its original planar shape. So that the completed embossed pads are formed to a correct height, the posts may be formed to overstretch the pads during embossing. In other words, the posts may be formed to overstretch the embossed pads (i.e., overshoot the target height of the embossed pads) so that, when the pads relax or contract, the completed embossed pads are formed closer to the target height. However, overstretching the pads and overshooting the height of the embossed pads places greater stresses on the flex circuit and the pads. In some cases, cracks or voids in the pad, tearing of the flex circuit dielectric, or an electrical open between the pad and a trace electrically connected thereto may result from excessive stress placed on the flex circuit during embossing.

Figure 2:
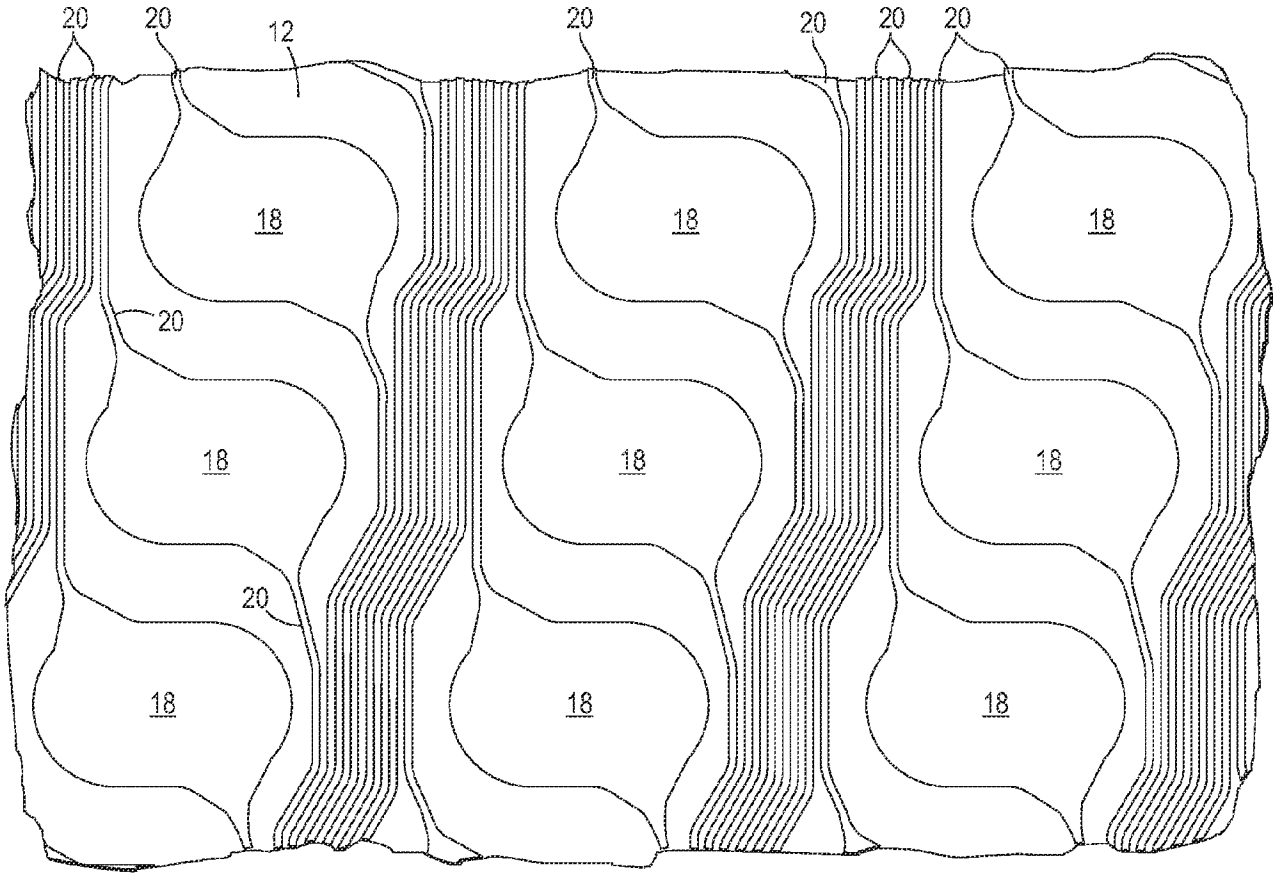
FIG. 2 is a plan view depicting a plurality of first flex circuit pads and a first plurality of first active traces on a first side of a dielectric substrate in an embodiment of the present teachings.

In-process structures which can be formed during an embodiment of the present teachings are depicted in FIGS. 1-4. FIG. 1 depicts an unembossed flex circuit 10 in accordance with an embodiment of the present teachings. The flex circuit 10 may include a dielectric substrate 12, such as a core polymer, having a first side or surface 14 and a second side or surface 16 opposite the first surface 14. Electrically active (i.e., active) first flex circuit pads 18 and first active traces 20 that are electrically coupled to the first flex circuit pads 18 are formed on the first surface 14 of active flex circuit 10. For purposes of the present teachings, an "active" structure refers to a structure that is electrically conductive and formed as part of an electric circuit in a completed printhead, while an "inactive" structure refers to an electrically conductive structure that is not part of an electric circuit in a completed printhead. Active first flex circuit pads 18 and first active traces 20 may be continuous (i.e., one or more of the first active traces 20 are electrically coupled to one or more of the active first flex circuit pads 18) and formed from the same patterned conductive layer as depicted. The flex circuit 10 may further include a dielectric solder mask 22 formed on the first surface 14 of the dielectric substrate 12 and on the first active traces 20 and active first flex circuit pads 18. A plan view of the flex circuit 10 including first flex circuit pads 18 and first active traces 20 is depicted in FIG. 2. While a 3×3 array of active first flex circuit pads 18 is depicted in FIG. 2, it will be understood that a completed printhead may include an array of several hundred or thousand active first flex circuit pads 18. Further, will be understood that the embodiments depicted in each of the FIGS. are generalized schematic illustrations and that other components may added or existing components may be removed or modified.

To increase available area for active structures, a plurality of second active traces 24 may formed on the second side 16 of the dielectric substrate 12. The second active traces 24 may be electrically coupled to first flex circuit pads 18 and/or first active traces 20 on the first side 14 of the dielectric substrate 12, or to other printhead structures such as a driver chip, for example an application specific integrated circuit (ASIC, not individually depicted for simplicity). The flex circuit 10 is thus a double-sided flex circuit 10, as active structures are formed on two different sides of the dielectric substrate 12.

Additionally, in an embodiment of the present teachings, second flex circuit pads 26 may be formed on the second side 16 of the dielectric substrate 12 as depicted in FIG. 1. At least a portion of second flex circuit pads 26 resides directly over first flex circuit pads 18. The second flex circuit pads 26 may be targeted to have a length, width, and/or shape that is larger than the first flex circuit pads 18, for example as depicted by second flex circuit pad 26A, the same size as first flex circuit pads 18, for example as depicted by second flex circuit pad 26B, or smaller than first flex circuit pads 18, for example as depicted by second flex circuit pad 26C. While FIG. 1 depicts three different widths (sizes) of second flex circuit pads 26A-26C for simplicity of depiction, it will be understood that the plurality of second flex circuit pads 26 in the second flex circuit pad array will generally have a uniform target size and shape across the array. In an embodiment, second flex circuit pads 26 may be formed to be congruent with, and directly overlying, first flex circuit pads 18, and at least a portion of each second flex circuit pad directly overlies a corresponding first flex circuit pad. As depicted in FIG. 1, the plurality of second active traces 24 are directly interposed directly between the plurality of second flex circuit pads 26. In an embodiment, second flex circuit pads 26 and second active traces 24 may be discontinuous (i.e., not electrically coupled together), but formed from the same patterned conductive layer as depicted. In this embodiment, the second flex circuit pads 26 may be electrically inactive, and thus not part of an electric circuit during operation of the printhead. In this embodiment, the inactive second flex circuit pads 26 serve to provide structural rigidity and stiffness for the first flex circuit pads 18 during and after the embossing process. In another embodiment, second flex circuit pads 26 and second active traces 24 may be continuous (i.e., electrically coupled together), and formed from the same patterned conductive layer. In this embodiment, the second flex circuit pads 26 may be electrically active, and thus part of an electric circuit during operation of the printhead. In this embodiment, the active second flex circuit pads 26 serve to provide structural rigidity and stiffness for the first flex circuit pads 18 during the embossing process, and also provide electrical functionality as part of an electric circuit during operation of the printhead. In another embodiment, active traces 24 on the second side 16 of the dielectric substrate 12 may be omitted, while second flex circuit pads 26, either active or inactive, are formed to provide rigidity and stiffness to the first flex circuit pads 18 during embossing as described below. Further, a dielectric layer (not depicted for simplicity) may be formed on the second side 16 of the dielectric substrate 12 that completely covers second flex circuit pads 26 and second traces 24, or that exposes a portion of second flex circuit pads 26 so that electrical contact may be made thereto.

After forming other otherwise providing the double-sided flex circuit 10, the flex circuit 10 may be embossed. FIG. 1 further depicts an embossing die 30 having a plurality of recesses 32 therein, and an embossing post plate 34 having a plurality of posts 36. The flex circuit 10, including the array of first flex circuit pads 18 and the array of second flex circuit pads 26, is interposed between the embossing die 30 and the embossing post plate 34 such that each of the posts 36 aligns with one of the recesses 32, one of the first flex circuit pads 18, and one of the second flex circuit pads 26 as depicted in FIG. 1.

Figure 3:
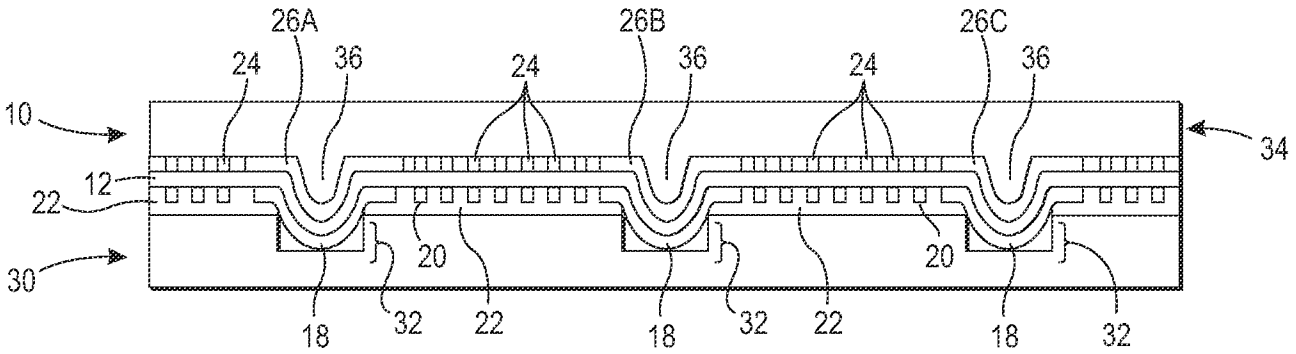
FIG. 3 is a cross section depicting embossing of an unembossed flex circuit in an embodiment of the present teachings.

Next, the embossing die 30 and embossing post plate 34 are pressed together such that the posts 36 force the first flex circuit pads 18 and the second flex circuit pads 26 into the recesses 32 as depicted in FIG. 3. During the pressing process, the second flex circuit pads 26 serve to add rigidity and stiffness to the flex circuit 10, specifically in the region of the first flex circuit pads 18. Because both the first flex circuit pads 18 and second flex circuit pads 26 are being embossed, the first flex circuit pads 18 relax less than if the second flex circuit pads 26 were not present, and thus maintain their shape. That is, when the metal is two sided and includes the first flex circuit pads 18 and the second flex circuit pads 26 with dielectric substrate 12 interposed therebetween, the resulting sandwich is stronger and less prone to relaxation and deformation. Copper, the traditional base metal of flex circuits, is malleable and takes on the shape of the embossed bump. Doubling a metal thickness by sandwiching the core polymer by two layers of metal may be used to increase robustness of the embossed metal. Overstretching of the first flex circuit pads 18, or overshooting their target height, may be reduced or eliminated, thereby decreasing the amount of stress placed on the flex circuit 10 during the embossing process. It will be realized that embodiments may include flex circuits 10 having more than two metal layers with two or more layers of second flex circuit pads 26 for each first flex circuit pad 18.

Figure 4:
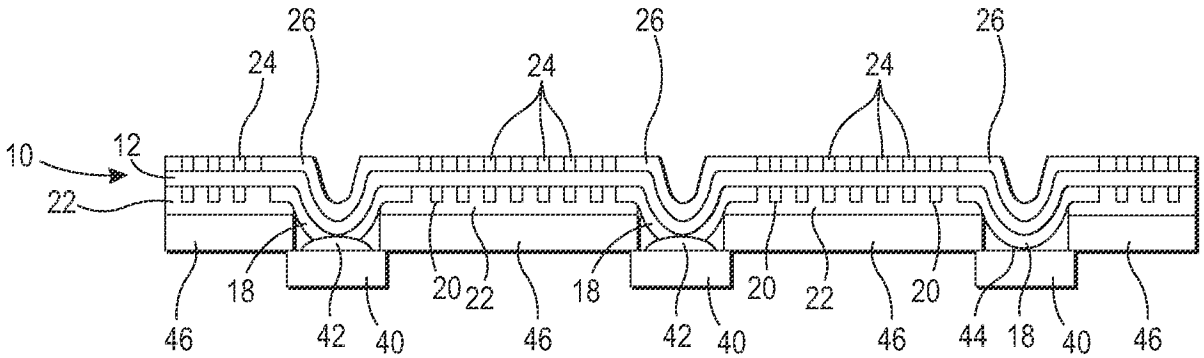
FIG. 4 is a cross section depicting an embossed flex circuit electrically coupled with a plurality of piezoelectric elements in an embodiment of the present teachings.

Subsequent to embossing, the flex circuit 10 may be removed from the embossing die 30 and embossing post plate 34. As depicted, an exposed lower surface of each first flex circuit pad 18 has a convex surface, while an exposed upper surface of each second flex circuit pad has a concave surface. Processing may then continue, for example by electrically coupling each first flex circuit pad 18 to a piezoelectric element 40 as depicted in FIG. 4. Electrical contact between each first flex circuit pad 18 and a piezoelectric element 40 may be established through a conductor 42, for example such as a metal or metal alloy such as solder, a conductive paste such as silver-filled epoxy, etc., or through asperity contact 44 without the use of a separate conductor, for example as discussed in US Pub. 20120274708, incorporated by reference above. It will be understood that the printhead of FIG. 4 may include other features as known in the art, such as a dielectric standoff layer 46, for example a laser-patterned polymer that may be used to contain the spread of conductor 42, as well as ink feed structures, ink reservoirs, a printhead diaphragm used for the ejection of ink during printing, and a printhead nozzle plate (not individually depicted for simplicity). The operation and ejection of ink or other fluids from a nozzle using actuation of a diaphragm using an array of piezoelectric elements 40 is well known.

Formation of second flex circuit pads 26 may be performed without additional cost or processing complexity. The same conductive layer used for the second active traces 24 on the second side of the dielectric substrate 12 may be used for the second flex circuit pads 26 as depicted in FIG. 1. Further, a mask or reticle (not depicted for simplicity) used to define the second active traces 24 may also be used to define the second flex circuit pads 26. Additionally, the array of second flex circuit pads 26 may be defined using an etch which also defines the plurality of second active traces 24.

Thus an embodiment of the present teachings may include an array of first flex circuit pads 18 and a plurality of first active traces 20 on a first surface 14 of a dielectric substrate 12 and an array of second flex circuit pads 26 and a plurality of second active traces 24 on a second surface 16 of the dielectric substrate 12. The plurality of first flex circuit pads 18 may be electrically active and configured to be part of an electric circuit during operation of the printhead. The plurality of second flex circuit pads 26 may be electrically active and configured to be part of an electric circuit during operation of the printhead, or may be electrically inactive and configured so as not to be part of any electric circuit during operation of the printhead. In either case, the array of second flex circuit pads 26 provides structural rigidity and stiffness to the array of first flex circuit pads 18 during printhead formation and operation.

Figure 5:
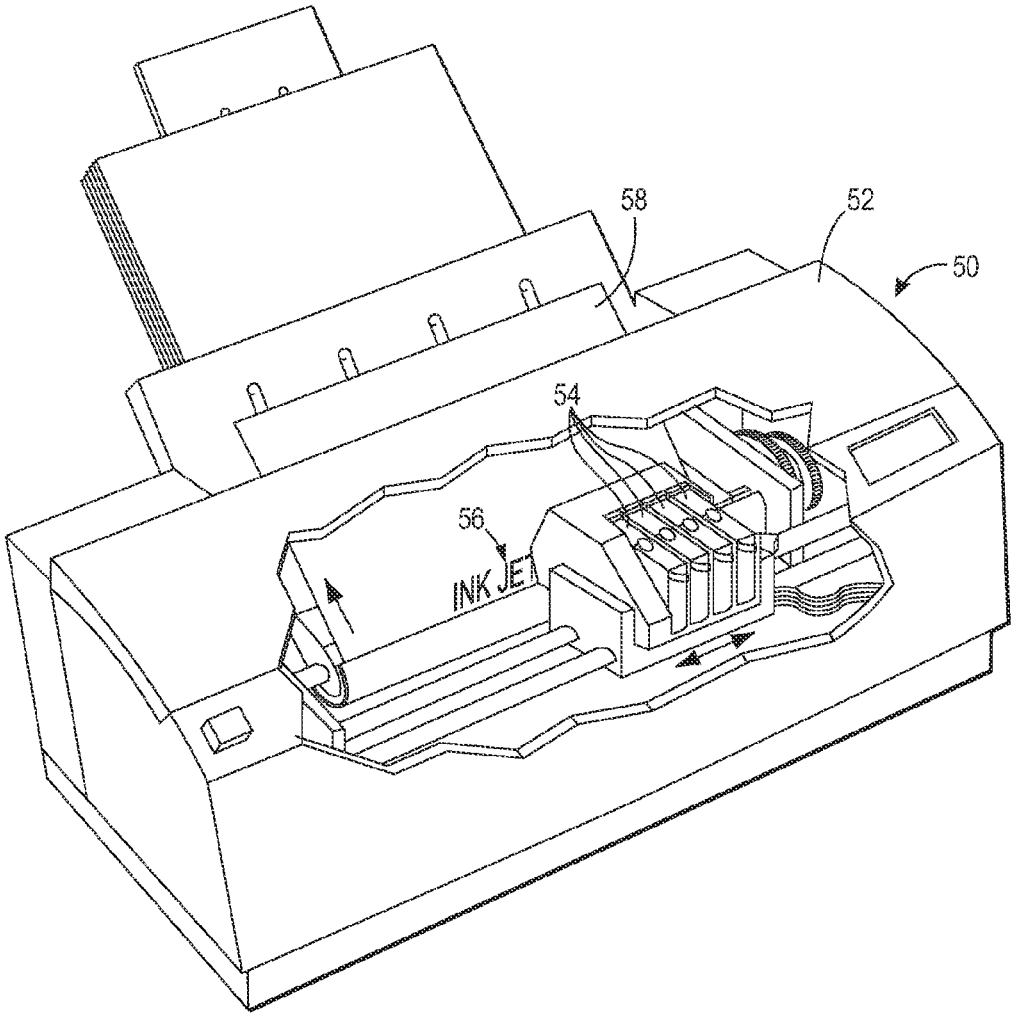
FIG. 5 is a perspective depiction of a printer including one or more printheads in accordance with an embodiment of the present teachings.

FIG. 5 depicts a printer 50 including a printer housing 52 into which at least one printhead 54 including an embodiment of the present teachings has been installed. The housing 52 may encase the printhead 54. During operation, ink 56 is ejected from one or more printheads 54. The printhead 54 is operated in accordance with digital instructions to create a desired image on a print medium 58 such as a paper sheet, plastic, etc. The printhead 54 may move back and forth relative to the print medium 58 in a scanning motion to generate the printed image swath by swath. Alternately, the printhead 54 may be held fixed and the print medium 58 moved relative to it, creating an image as wide as the printhead 54 in a single pass. The printhead 54 can be narrower than, or as wide as, the print medium 58. In another embodiment, the printhead 54 can print to an intermediate surface such as a rotating drum, belt, or drelt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead, comprising:

a dielectric substrate comprising a first side and a second side opposite the first side;

a plurality of first active traces on the first side of the dielectric substrate;

a plurality of embossed first flex circuit pads on the first side of the dielectric substrate; and a plurality of embossed second flex circuit pads on the second side of the dielectric substrate, wherein:

at least a portion of each embossed second flex circuit pad directly overlies a corresponding first flex circuit pad;

the plurality of second flex circuit pads are not part of an electric circuit in the printhead and are configured to be electrically inactive; and the plurality of embossed first flex circuit pads and the plurality of embossed second flex circuit pads are pads that have been embossed between an embossing die and an embossing post plate.

2. The printhead of claim 1, further comprising a plurality of second active traces on the second side of the dielectric substrate, wherein the plurality of second active traces are directly interposed between the plurality of second flex circuit pads.

3. The printhead of claim 1, wherein the plurality of embossed first flex circuit pads are configured to be electrically active during operation of the printhead.

4. The printhead of claim 1, wherein the plurality of embossed second flex circuit pads are targeted to have a size and shape that is congruent with a size and shape of the plurality of embossed first flex circuit pads.

5. The printhead of claim 1, further comprising:

a plurality of piezoelectric elements; and a conductive layer that electrically couples each of the plurality of first flex circuit pads with one of the plurality of piezoelectric elements.

6. The printhead of claim 1, further comprising:

a plurality of piezoelectric elements, wherein electrical communication between the plurality of piezoelectric elements and the plurality of first flex circuit pads is established through asperity contact.

7. The printhead of claim 1, wherein the plurality of second active traces are formed from a same layer as the plurality of second flex circuit pads.

8. The printhead of claim 1, wherein:

each embossed first flex circuit pad of the plurality of embossed first flex circuit pads comprises a convex lower surface; and each embossed second flex circuit pad of the plurality of embossed second flex circuit pads comprises a concave upper surface.

9. A printer, comprising:

a printhead, comprising:

a dielectric substrate comprising a first side and a second side opposite the first side;

a plurality of first active traces on the first side of the dielectric substrate;

a plurality of embossed first flex circuit pads on the first side of the dielectric substrate; and a plurality of embossed second flex circuit pads on the second side of the dielectric substrate, wherein:

at least a portion of each embossed second flex circuit pad directly overlies a corresponding first flex circuit pad;

the plurality of second flex circuit pads are not part of an electric circuit in the printhead and are configured to be electrically inactive during operation of the printhead; and the plurality of embossed first flex circuit pads and the plurality of embossed second flex circuit pads are pads that have been embossed between an embossing die and an embossing post plate; and a printer housing that encases the printhead.

10. The printer of claim 9, further comprising a plurality of second active traces on the second side of the dielectric substrate, wherein the plurality of second active traces are directly interposed between the plurality of second flex circuit pads.

11. The printer of claim 9, wherein the plurality of embossed first flex circuit pads are configured to be electrically active during operation of the printhead.

12. The printer of claim 9, wherein the plurality of embossed second flex circuit pads are targeted to have a size and shape that is congruent with a size and shape of the plurality of embossed first flex circuit pads.

13. The printer of claim 9, further comprising:

a plurality of piezoelectric elements; and a conductive layer that electrically couples each of the plurality of first flex circuit pads with one of the plurality of piezoelectric elements.

14. The printer of claim 9, further comprising:

a plurality of piezoelectric elements, wherein electrical communication between the plurality of piezoelectric elements and the plurality of first flex circuit pads is established through asperity contact.

15. The printer of claim 9, wherein the second plurality of second active traces are directly interposed between the plurality of second flex circuit pads.

16. The printer of claim 9, wherein the plurality of second active traces are formed from a same layer as the plurality of second flex circuit pads.

17. The printer of claim 12, wherein:

each embossed first flex circuit pad of the plurality of embossed first flex circuit pads comprises a convex lower surface; and each embossed second flex circuit pad of the plurality of embossed second flex circuit pads comprises a concave upper surface.

18. A method for forming a printhead, comprising:

forming a first plurality of first active traces on a first side of a dielectric substrate;

forming a plurality of planar first flex circuit pads on the first side of the dielectric substrate;

forming a second plurality of second active traces on a second side of the dielectric substrate that is opposite to the first side;

forming a plurality of planar second flex circuit pads on the second side of the dielectric substrate, wherein at least a portion of each embossed second flex circuit pad directly overlies a corresponding first flex circuit pad;

embossing the plurality of planar first flex circuit pads to form a plurality of embossed flex circuit pads and embossing the plurality of second flex circuit pads to form a plurality of embossed second flex circuit pads, wherein the embossing of the plurality of planar first flex circuit pads and the plurality of planar second flex circuit pads uses a method comprising:

interposing the plurality of planar first flex circuit pads and the plurality of planar second flex circuit pads between a plurality of recesses within an embossing die and a plurality of posts of an embossing post plate; and pressing each of the plurality of posts into one of the plurality of recesses with the plurality of first and second flex circuit pads interposed therebetween, thereby embossing the plurality of first and second flex circuit pads.

19. The method of claim 18, wherein:

the plurality of embossed first flex circuit pads are configured to be electrically active during operation of the printhead; and the plurality of embossed second flex circuit pads are not part of an electric circuit in the printhead and are configured to be electrically inactive during operation of the printhead.

20. The method of claim 18, wherein:

the plurality of embossed first flex circuit pads are configured to be electrically active during operation of the printhead; and the plurality of embossed second flex circuit pads are configured to be electrically active during operation of the printhead.

* * * * *